US007908768B2

(12) United States Patent
Cheskin et al.

(10) Patent No.: US 7,908,768 B2
(45) Date of Patent: Mar. 22, 2011

(54) SHOE INSOLE

(75) Inventors: Melvyn P. Cheskin, Deerfield Beach, FL (US); Ray M. Fredericksen, Haslett, MI (US)

(73) Assignee: Spenco Medical Corporation, Waco, TX (US)

( * ) Notice: Subject to any disclaimer, the term of this patent is extended or adjusted under 35 U.S.C. 154(b) by 0 days.

(21) Appl. No.: 12/580,752

(22) Filed: Oct. 16, 2009

(65) Prior Publication Data

US 2010/0095552 A1 Apr. 22, 2010

Related U.S. Application Data

(60) Continuation of application No. 12/336,146, filed on Dec. 16, 2008, now Pat. No. 7,665,169, which is a division of application No. 11/202,620, filed on Aug. 12, 2005, now Pat. No. 7,484,319.

(51) Int. Cl.
*A43B 13/38* (2006.01)

(52) U.S. Cl. ..... 36/44; 36/144

(58) Field of Classification Search ..... 36/44, 28, 36/43, 142–144, 150, 155, 173, 174
See application file for complete search history.

(56) References Cited

U.S. PATENT DOCUMENTS

| | | | | |
|---|---|---|---|---|
| 3,084,695 | A | 4/1963 | O'Donnell | |
| 4,435,910 | A | 3/1984 | Marc | |
| 4,597,196 | A | 7/1986 | Brown | |
| 5,014,706 | A * | 5/1991 | Philipp | 36/140 |
| 5,400,528 | A | 3/1995 | Skinner | |
| 5,438,768 | A | 8/1995 | Bauerfeind | |
| 5,669,162 | A | 9/1997 | Dyer | |
| 6,105,283 | A | 8/2000 | Park | |
| 6,510,626 | B1 | 1/2003 | Greenawalt | |
| 6,598,319 | B2 | 7/2003 | Hardt | |
| 6,684,532 | B2 | 2/2004 | Greene et al. | |
| 7,107,705 | B2 | 9/2006 | Dalton et al. | |
| 7,484,319 | B2 * | 2/2009 | Cheskin et al. | 36/44 |
| 7,665,169 | B2 * | 2/2010 | Cheskin et al. | 12/146 B |
| 2002/0050080 | A1 | 5/2002 | Vasyli | |
| 2003/0093920 | A1 * | 5/2003 | Greene et al. | 36/25 R |
| 2004/0025374 | A1 | 2/2004 | Basso | |
| 2004/0118017 | A1 * | 6/2004 | Dalton et al. | 36/44 |
| 2004/0194344 | A1 | 10/2004 | Tadin | |

FOREIGN PATENT DOCUMENTS

| | | | |
|---|---|---|---|
| EP | 0774219 | A2 | 5/1997 |
| WO | WO2006/035469 | A2 | 4/2006 |
| WO | WO2007/021328 | A1 | 2/2007 |

OTHER PUBLICATIONS

PCT "International Search Report and Written Opinion," dated Mar. 13, 2007, for counterpart International Patent Application No. PCT/US2006/042885.

PCT "International Search Report and Written Opinion," dated Jul. 27, 2006, for counterpart International Patent Application No. PCT/US2006/014681.

* cited by examiner

*Primary Examiner* — Ted Kavanaugh

(74) *Attorney, Agent, or Firm* — Hemingway & Hansen, LLP; Eugenia S. Hansen

(57) ABSTRACT

An insole providing cushioning and control of foot motion. The insole includes a stability cradle and pods secured to the underside of the insole core or base. A lateral heel pod and a medial heel pod have differing material properties selected to help control foot pronation.

51 Claims, 7 Drawing Sheets

SHOE INSOLE

TECHNICAL FIELD

The present invention relates in general to an improved shoe insole and more particularly to an insole providing improved cushioning and support to the foot of a wearer.

BACKGROUND OF THE INVENTION

The human foot is a very complex biological mechanism. While walking the load on the foot at heel strike is typically about one and a half times a person's body weight. When running or carrying extra weight, such as a backpack, loads on the foot may exceed three times the body weight. The many bones, muscles, ligaments, and tendons of the foot function to absorb and dissipate the forces of impact, carry the weight of the body and other loads, and provide forces for propulsion. Properly designed shoe insoles can assist the foot in performing these functions and protect the foot from injury.

Insoles may be custom made to address the specific needs of an individual. They may be made based on casts of the end user's foot or may be made of a thermoplastic material that is molded to the contours of the end user's foot. However, it is not practical to make such insoles for the general public. Like most custom made items, custom insoles tend to be expensive because of the low volume and extensive time needed to make and fit them properly.

To be practical for distribution to the general public, an insole must be able to provide benefit to the user without requiring individualized adjustment and fitting. A first type of insole commonly available over-the-counter emphasizes cushioning the foot so as to maximize shock absorption. For typical individuals cushioning insoles perform adequately while engaged in light to moderate activities such as walking or running. That is, a cushioning insole provides sufficient cushioning and support for such activities. However, for more strenuous or technically challenging activities, such as carrying a heavy backpack or traversing difficult terrain, a typical cushioning insole may not be adequate. Under such conditions, a cushioning insole by itself would not provide enough support and control, and may tend to bottom out during use.

Another type of over-the-counter insole emphasizes control. Typically, such insoles are made to be relatively stiff and rigid so as to control the bending and twisting of the foot by limiting foot motion. The rigid structure is good at controlling motion, but is not very forgiving. As a result, when motion of the foot reaches a limit imposed by the rigid structure, the load on the foot tends to change abruptly and may increase the load on the structures of the foot. Because biological tissues such as tendons and ligaments are sensitive to the rate at which they are loaded, the abrupt change in load may cause injury or damage.

In view of the foregoing, it would be desirable to provide an over-the-counter insole that provides both cushioning and control.

It would also be desirable to provide an insole that provides both cushioning and control and is practical for use by the general public.

SUMMARY OF THE INVENTION

In view of the foregoing, it is therefore an object of the present invention to provide an over-the-counter insole that provides both cushioning and control.

It is also an object of the present invention to provide an insole that provides both cushioning and control and is practical for use by the general public.

The above, and other objects and advantages of the present are provided by an insole that provides both motion control and cushioning. The insole includes a system of interacting components that cooperate to achieve a desired combination of foot cushioning and motion control. The components include a foam core, a semi-rigid stability cradle, and a number of elastomeric pods and pads. The characteristics of the components, their size and shape, and their position are selected to provide a desired blend of cushioning and control, and more specifically to achieve a desired biomechanical function.

In accordance with principles of the present invention, a cushioning core or base is combined with a relatively stiff stability cradle and a number of elastomeric pods to form an insole that provides cushioning, stability, and control. By altering the size, shape, and material properties of the pods insoles may be designed to address issues of over/under pronation, over/under supination, and other problems related to foot motion.

In a preferred embodiment of the present invention, the components of an insole are permanently affixed to each other to create an insole designed for an intended type or category of activity. Many insole designs may then be made available to address a broad range of different activities. In an alternative embodiment of the invention, an insole may comprise a kit including a number of interchangable pods having different characteristics. Using such a kit, an end user may selectivley change the pods to customize the insole to accommodate a specific activity.

BRIEF DESCRIPTION OF THE DRAWINGS

The above, and other objects and advantages of the present invention will be understood upon consideration of the following detailed description taken in conjunction with the accompanying drawings, in which like reference characters refer to like parts throughout, and in which.

DETAILED DESCRIPTION

Figure 1:
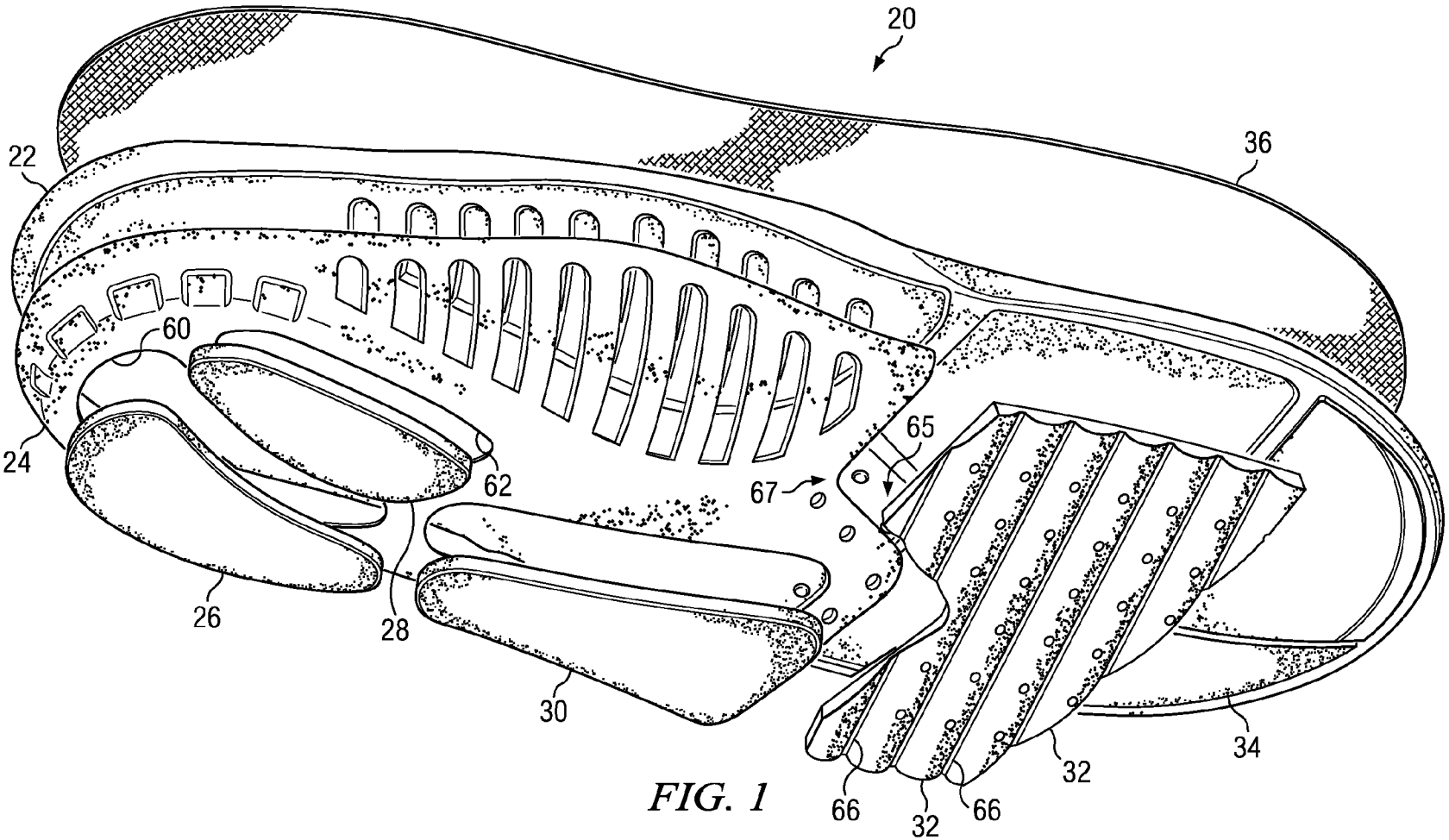
FIG. 1 is an exploded perspective view of an illustrative embodiment of an insole in accordance with the principles of the present invention.

In reference to FIGS. 1 to 11, an insole constructed in accordance with the principles of the present invention is disclosed. As shown in the exploded view of FIG. 1, insole 20 is a composite structure including base 22, stability cradle 24, lateral heel pod 26, medial heel pod 28, lateral midfoot pod 30, forefoot pod 32, valgus pad 34, and top sheet 36. Although it is not visible in FIG. 1, insole 20 also includes a thin pad disposed between base 22 and top sheet 36 to form transverse arch support 38 which is visible in FIGS. 4 and 9.

Figure 2:
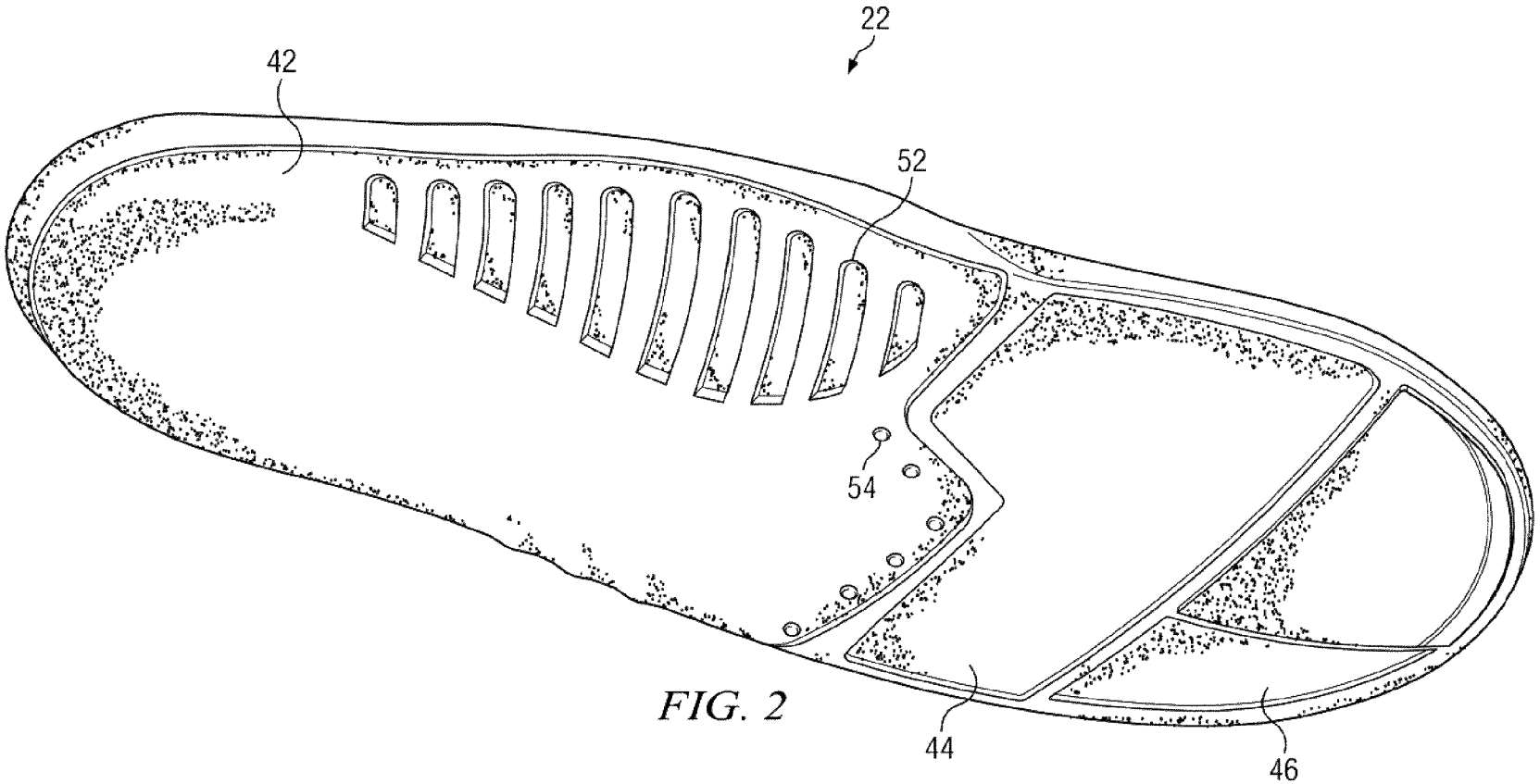
FIGS. 2 and 3 are perspective views showing, respectively, the base and stability cradle of the insole of FIG. 1.
Figure 3:
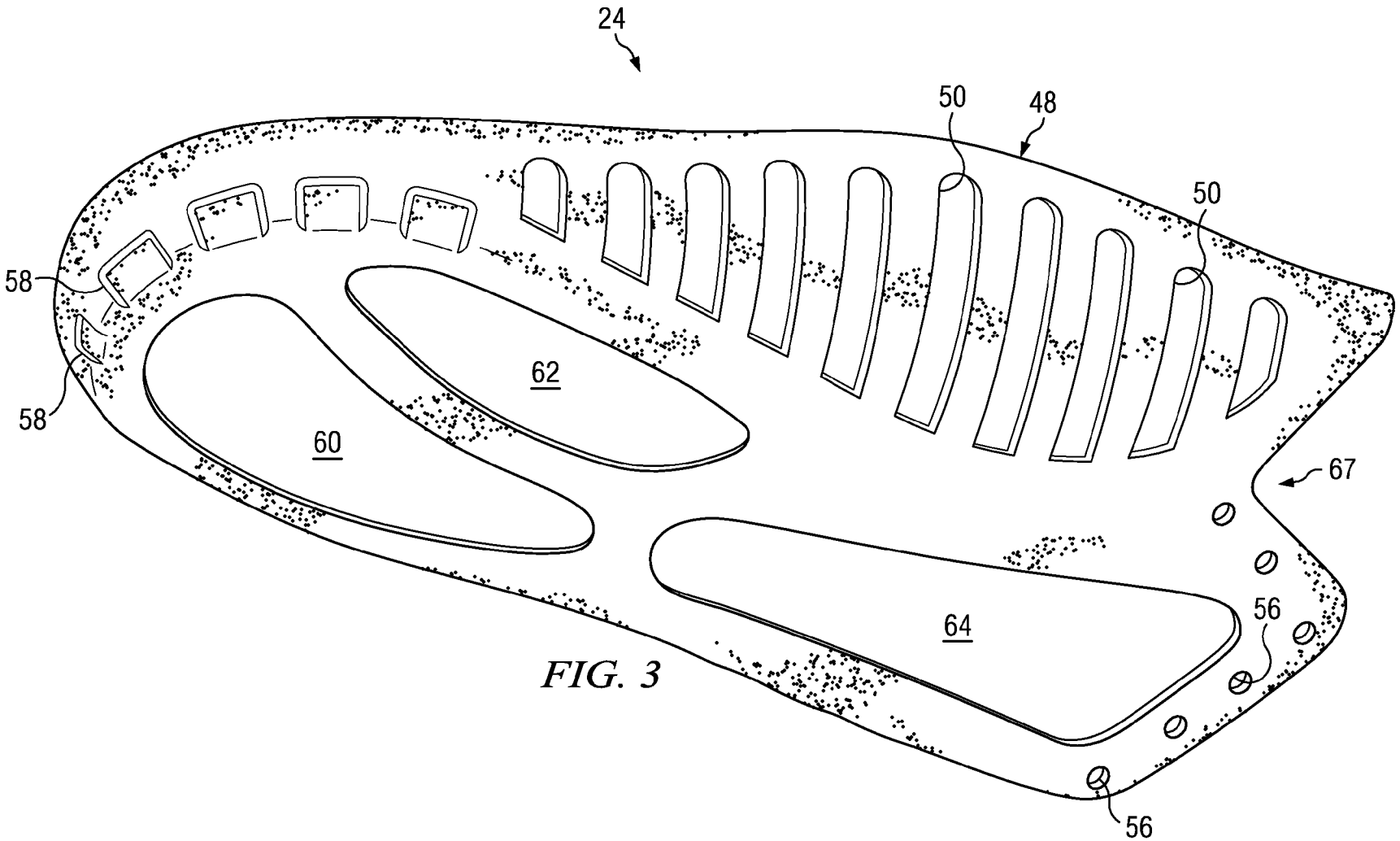
Figure 4:
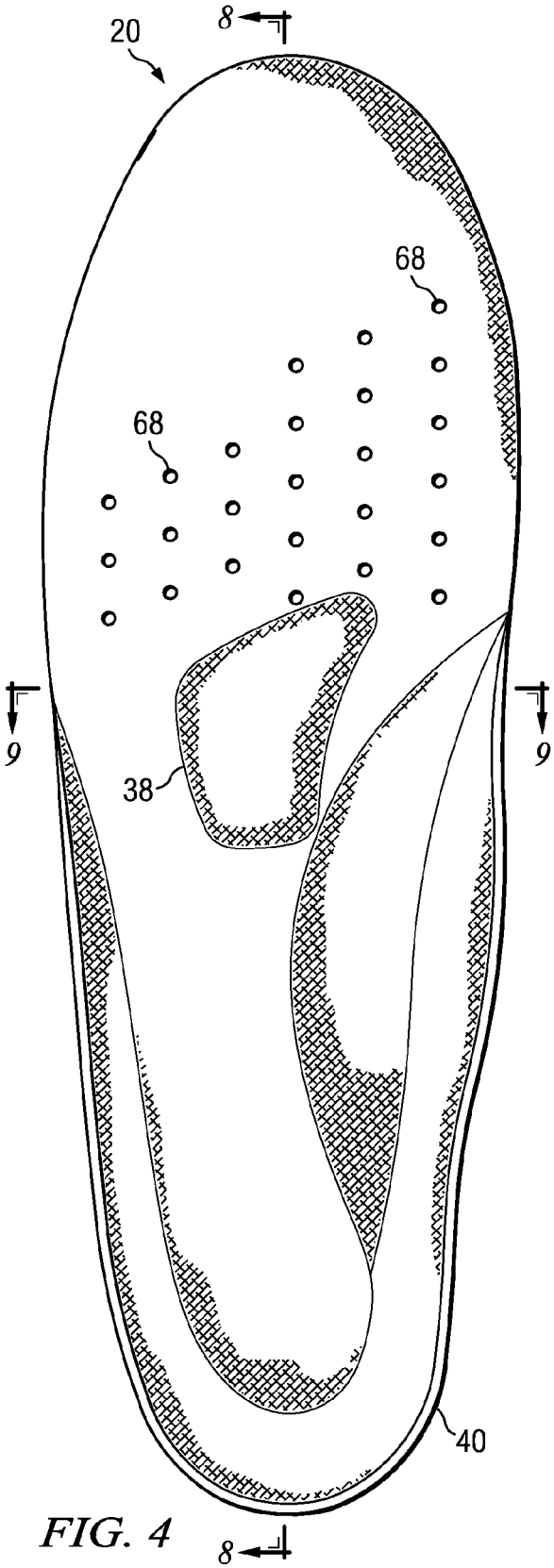
FIGS. 4 to 7 are, respectively, dorsal (top), plantar (bottom), lateral (outside), and rear views of the insole of FIG. 1.
Figure 6:
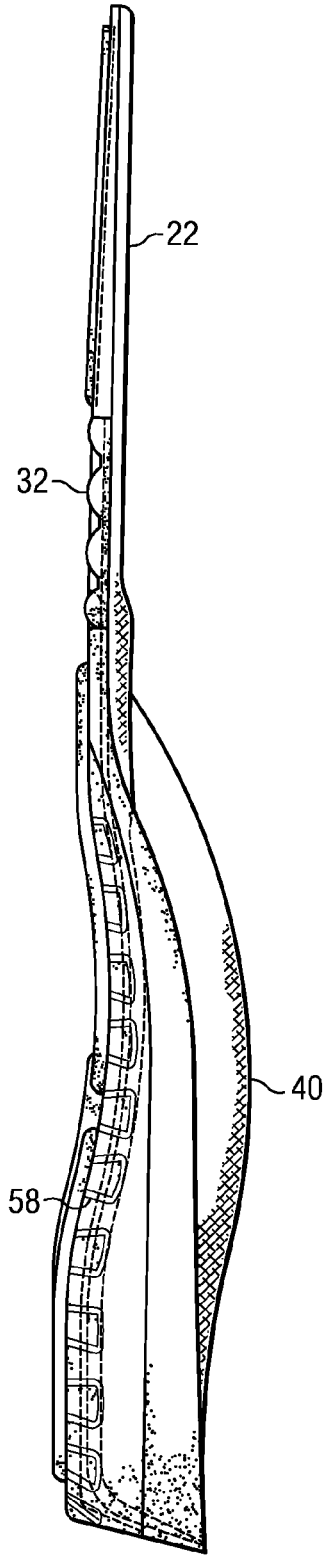

As shown in FIG. 2, base 22 generally has the shape of a full or partial insole. Base 22 is preferably made of one or more layers of foam or other material having suitable cushioning properties. For example, base 22 may include a top layer comprising about 2 mm of EVA foam having a durometer (hardness) from about Shore C 25-55 and a bottom layer comprising about 4.5 mm of EVA foam having a durometer of about Shore C 40-65. More preferably, the material of base 22 is selected based on an expected type of activity of the user of the insole. A softer material would be selected for an insole to be used during light activites; whereas harder materials would be more appropriate for demanding activities. For example, a base comprising an EVA top layer with a durometer of about Shore C 30-35 and an EVA bottom layer with a durometer of about Shore C 45 would be a suitable base for an insole designed for activities such as day hiking; whereas, top and bottom EVA layers having durometers of about Shore C 45-50 and Shore C 60, respectively, may be more appropriate for an insole intended to be used while backpacking.

Base 22 has a raised edge 40 that wraps around the heel and extends partially along the sides of the foot such that the insole conforms to the natural shape of the foot. As seen in FIGS. 6-10, the height of raised edge 40 is generally higher, and the base material is thicker, on the medial side of the foot and is lower on the lateral side. Base 22 also includes recesses 42, 44, and 46 for mating with stability cradle 24, forefoot pod 32, and valgus pad 34, respectively.

Base 22 is partially disposed within stability cradle 24, which provides some rigidity to insole 20. Preferably, stability cradle 24 is made of a material having sufficient rigidity to control foot motion. For example, stability cradle 24 may be made of polypropylene having a durometer of Shore A 90.

Stability cradle 24 generally extends under the from the calcaneus through the midtarsal joints of the foot. However, the forward medial portion is shaped to accommodate downward motion of the 1$^{st}$ metatarsal during toe off, as is described below. Indentations 58 around the heel and along the lateral side of stability cradle 24 help improve the fit of insole 20 into a shoe and minimize movement between insole 20 and the shoe.

As shown in FIGS. 6 to 10, stability cradle 24 includes walls that wrap up the sides and rear of base 22 to provide support for the foot. Preferably, stability cradle 24 is approximately 3 mm thick and the walls taper from approximately 2 mm to about 0.5 mm. The sides of stability cradle 24 are preferably higher on the medial side of the foot because of the higher loading. For example, medial side 48 of stability cradle 24 extends upward under the medial longitudinal arch. Slots 50 improve flexibility along the medial side of stability cradle 24 without sacrificing longitudinal arch support. Preferably, base 22 is molded so that portions 52 and 54 of the foam material project into slots 50 and holes 56 so that it is approximately flush with the outer surface of stability cradle 24, so as to mechanically lock stability cradle 24 and base 22 together. Advantageously, the foam is also able to bulge through slots 50 when base 22 is compressed, e.g., while walking to provide additional cushioning to the arch.

Pods 26 to 30 are affixed to the bottom of base 22 through corresponding openings 60 to 64 in stability cradle 24. Forefoot pod 32 and valgus pad 34 are affixed to the bottom of base 22 forward of stability cradle 24, and top sheet 36 is affixed to the top surface of base 22. As will be discussed below, the size, shape, and placement of these pods and pads are based on the location of various anatomical landmarks of the foot and the biomechanics of foot motion.

Foot contact with the ground is generally divided into three phases: heel strike, midfoot support, and toe off. During heel strike, the heel of the foot impacts the ground with significant force. To cushion the impact, lateral heel pod 26 is positioned along the rear and lateral side of the calcaneus (heel bone) and projects below stability cradle 24. Preferably, lateral heel pod 26 is made of a material having suitable cushioning properties. For example, lateral heel pod 26 may comprise approximately 6 mm of a polyurethane material with a durometer of about Shore C 40-60. More preferably, the characteristics of lateral heel pod 26 are selected based on an intended type of activity. For example, a polyurethane having a durometer of about Shore C 45-50 would be appropriate for lateral heel pod 26 in an insole designed for activities such as day hiking; whereas a polyurethane having a durometer of about Shore C 50-55 would be more appropriate in an insole designed for activities such as backpacking.

Following the initial impact of the heel with the ground, the foot twists, or pronates, bringing the medial side of the heel into contact with the ground. The foot is sensitive to the amount of pronation as well as the rate at which the pronation occurs. Pronation is natural, and some degree of pronation is desirable because it serves to absorb the stresses and forces on the foot during walking or running. However, an excessive amount or rate of pronation may result in injury.

Stability cradle 24 provides firm support along the medial portion of the foot to help control the amount of pronation. Medial heel pod 28 helps to control the rate of pronation by forming medial heel pod 28 out of a material having different characteristics than lateral heel pod 26. For example, to reduce a pronation rate, medial heel pod 28 may be made from a firmer material than lateral heel pod 26. A firmer or stiffer material does not compress as much or as fast as a softer material under the same load. Thus, a medial heel pod made from a firmer material would compress less than a lateral heel pod made of a softer material. As a result, medial heel pod 28 tends to resist or counteract pronation and thereby help to reduce the degree and rate of pronation. Conversely, making medial heel pod 28 from a softer material than lateral heel pod 26 would tend to increase the amount and rate of pronation.

Preferably, the firmness of the material used in medial heel pod 28 is selected based on the firmness of lateral heel pod 26 and on the type of intended activity. For example, the firmness of lateral heel pod 26 and medial heel pod 28 may differ by about 20-30% for an insole to be used during light to moderate activities. More specifically, lateral and medial heel pods having durometer values of approximately Shore C 45-50 and about Shore C 60, respectively, would be suitable for an insole designed to be used during light hiking.

Carrying a heavy backpack significantly increases the load on the foot and the rate of pronation during and following heel strike. Accordingly, medial heel pod 28 may be made significantly firmer in an insole designed for use while backpacking. As an example, a difference in firmness of about 20-40% may be more appropriate for such activities. More specifically, lateral and medial heel pods having durometer values of approximately Shore C 50-55 and about Shore C 65-70, respectively, would be suitable for an insole designed to be used during backpacking.

Midfoot pod 30 provides cushioning and control to the lateral side of the foot during the midstance portion of a step. Typically, midfoot pod 30 is formed of a material having the same properties, e.g., firmness, as lateral heel pod 26. However, a material having different characteristics may also be used.

Figure 5:
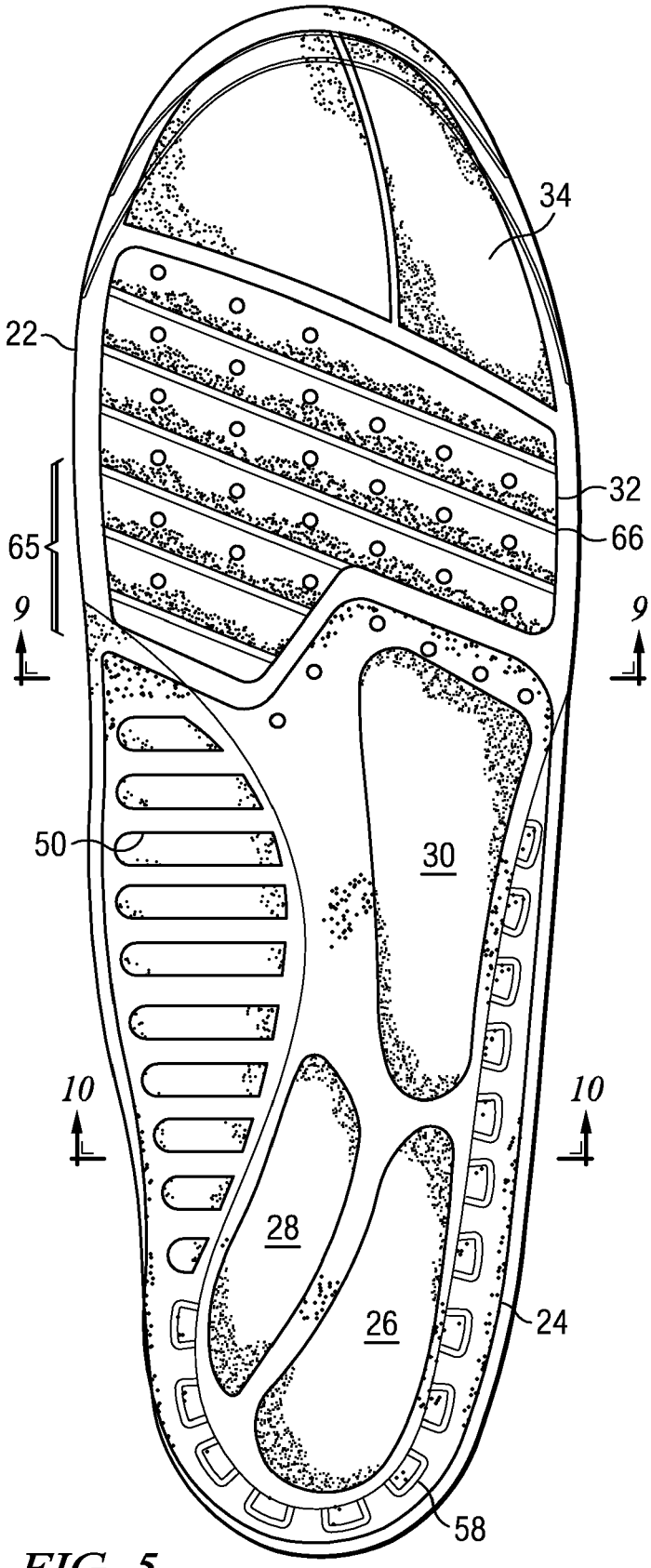
Figure 7:
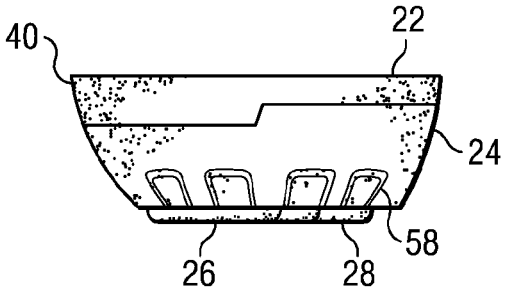
Figure 9:
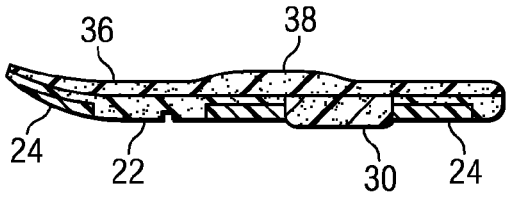
FIGS. 9 and 10 are transverse cross sectional views of the insole of FIG. 1.
Figure 10:
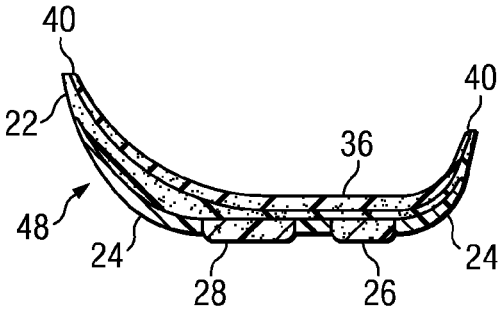
Figure 8:
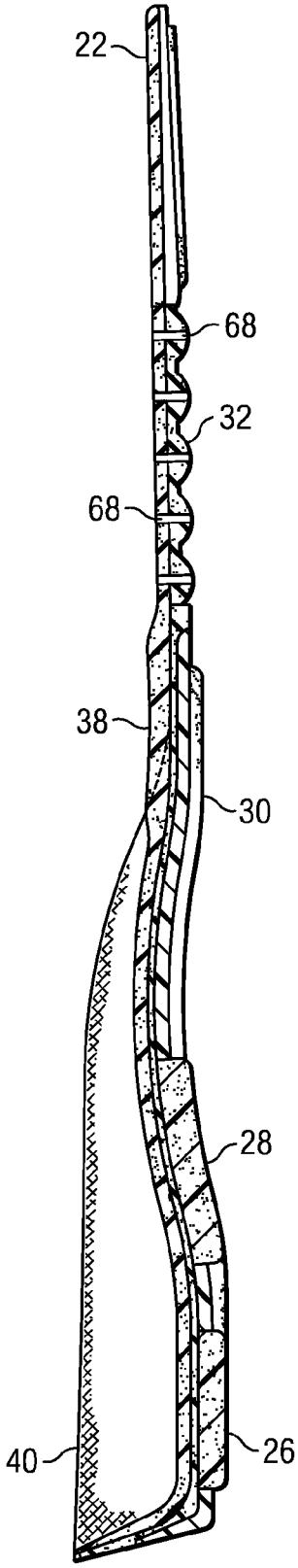
FIG. 8 is a longitudinal cross sectional view of the insole of FIG. 1.

At the beginning of the propulsion or toe-off phase of a step, the heel begins to lift from the ground and weight shifts to the ball of the foot. Forefoot pod 32 is located under this part of the foot. Preferably, forefoot pod 32 is formed of a relatively resilient material so that energy put into compressing forefoot pod 32 is returned to help propel the foot at toe-off. For example, forefoot pod 32 may comprise a layer of an EVA material approximately 6.5 mm thick with a durometer of about 25-45 Shore C, and more particularly about 30-40 Shore C. Preferably, forefoot pod 32 includes diagonal grooves 66 as shown in FIGS. 1 and 5. Grooves 66 are angled to correspond to the hinge line of the joints in the ball of the foot to increase the flexibility of forefoot pod 32.

During toe off, the first metatarsal naturally flexes downward. Preventing this natural downward flex of the first metatarsal causes the arch of the foot to flatten and the foot to over pronate, increasing stress on the ankles and knees. To accommodate the downward flex, medial portion 65 of forefoot pod 32 extends rearward into corresponding concave portion 67 of stability cradle 24. The shape of the stability cradle and forefoot pod permit the first metatarsal to flex more naturally and thereby encourage loading of the great toe during toe off.

Valgus pad 34 is positioned under the toes on the lateral side of the foot. Preferably valgus pad 34 is firmer than base 22 to further encourage loading of the great toe during toe off. For example, valgus pad 34 may comprise a 1.5 mm layer of EVA having a durometer of about Shore C 70

In a preferred embodiment, base 22 is covered with top sheet 36, which is preferably a non-woven fabric layer with a low coefficient of friction so as to minimize the possibility of blisters. In a preferred embodiment, the fabric is treated with an antibacterial agent, which in combination with a moisture barrier reduces odor causing bacteria and fungi. A series of air ports 68 extend through top sheet 36, base 22 and forefoot pod 32 to permit air circulation above and below insole 20.

Figure 11:
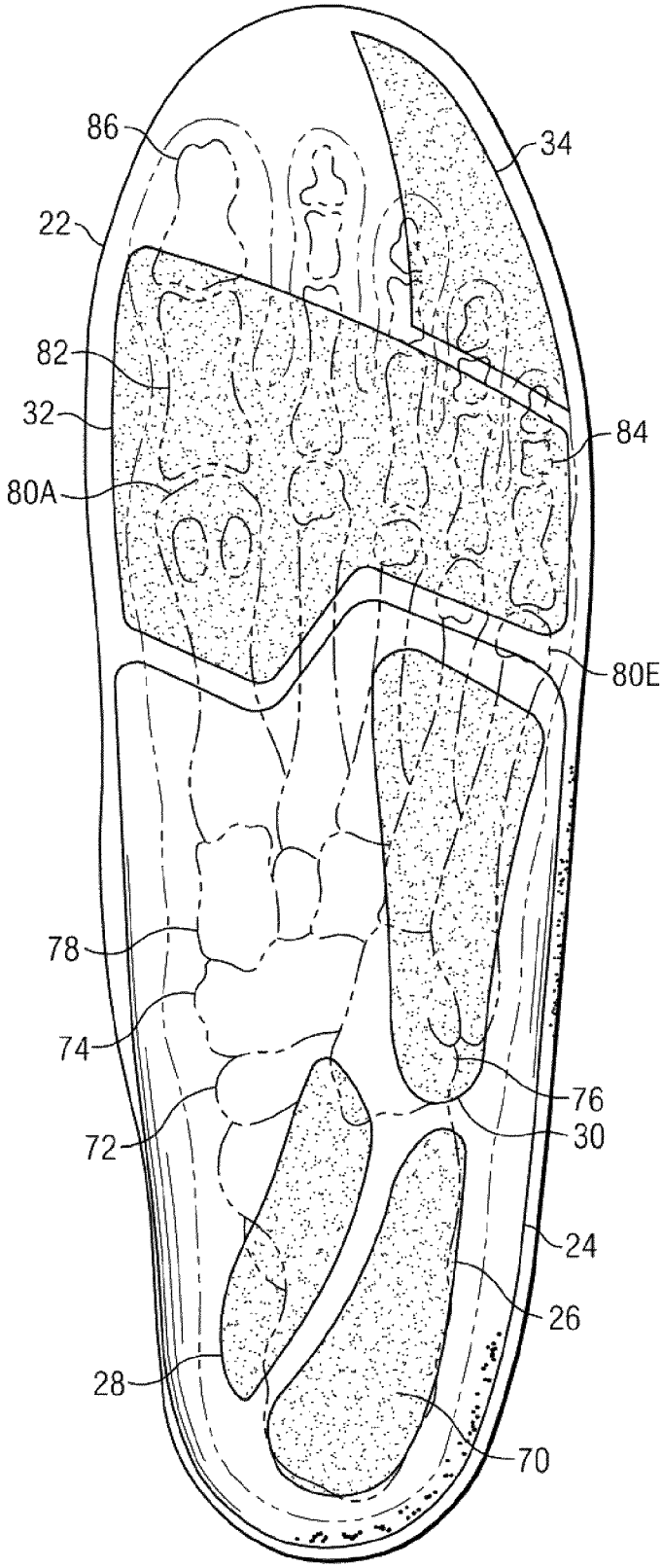
FIG. 11 is a view of the bones of the foot superimposed on a plantar view of the insole of FIG. 1.

FIG. 11 illustrates the bones of the foot superimposed over a bottom view of the insole of the present invention. At the heel of the foot is the calcaneus 70 and forward of the calcaneus is the talus 72. Forward of the talus 72 on the medial side is the navicular 74 and on the lateral side is the cuboid 76. Forward of the cuboid and the navicular are cuneiforms 78. Forward of the cuneiforms 78 and cuboid 76 are the metatarsals 80A-80E. The first metatarsal 80A is located on the medial side of the foot and the fifth metatarsal 80E is located on the lateral side of the foot. Forward of the metatarsals are the proximal phalanges 82. Forward of the proximal phalanges 82 are the middle phalanges 84, and at the end of each toe are the distal phalanges 86.

In a first preferred embodiment of the present invention, the various components of an insole constructed according to the principles of the present invention are permanently affixed to base 22 using an appropriate means such as an adhesive. In an alternative embodiment of the present invention, at least some of the components, and the pods in particular, are affixed to base 22 in a way that they can be changed or replaced. For example, pods 26-32 may be attached to base 22 using hook and loop fasteners, a temporary adhesive, or other removable means of attachment. By providing an insole kit including interchangeable components an end user may adapt the insole to their specific needs or to a specific end use. For example, an end user that is susceptible to over pronation or that will be hiking with a particularly heavy backpack may select a medial heel pod that is somewhat firmer than a typical user.

While the present invention has been described in relation to preferred embodiments, the detailed description is not limiting of the invention and other modifications will be obvious to one skilled in the art. For example, the illustrative embodiments of the invention disclosed above are premised on a need to control over pronation. Thus, the illustrative embodiments have a medial heel pod that is firmer than the lateral heel pod. However, under pronation may be addressed by using a softer medial heel pod. Similarly, over or under supination during toe off may be addressed by changing the characteristics of any of base 22, forefoot pod 32, and valgus pad 34.

The present invention has been disclosed in the context of providing an over-the-counter insole that may be made available for distribution to the general public. However, the same principles may be used by a podiatrist or other medical professional to design or create an insole to address the needs of a specific patient.

Thus, an improved insole has been disclosed. It will be readily apparent that the illustrative embodiments of an insole thus disclosed may be useful in cushioning the foot and controlling pronation during activities such as hiking, backpacking, and the like. However, one will understand that the components of the insole system may be modified to accommodate other activities or to control other kinds of foot motion. Thus, the description provided herein, including the presentation of specific thicknesses, materials, and properties of the insole components, is provided for purposes of illustration only and not of limitation, and that the invention is limited only by the appended claims.

What is claimed is:

1. An insole having a top surface for contacting a user's foot and a bottom surface for contacting the inside of a user's shoe, comprising:

a. a base, said base having a base top side and a base bottom side, said base having a heel end, a toe end, a first lateral side defining an inner arch area and a second lateral side defining an outer border area, said lateral sides extending from said heel end to said toe end, said base bottom side defining a toe area, a forefoot area, and a stability area;

b. a stability cradle made of semi-rigid material, said stability cradle having a cradle top side and a cradle bottom side, said stability cradle defining at least three openings extending from said cradle top side to said cradle bottom side, said cradle top side affixed to said stability area of said base bottom side whereby said base bottom side and said openings define first, second and third recesses in said insole bottom surface; and c. a system of interacting cooperative components integrated into said base and said stability cradle, said system comprising a lateral heel pod inserted into said first recess, a medial heel pod inserted into said second recess, and a lateral midfoot pad inserted into said third recess.

2. The insole of claim 1, wherein said forefoot area of said base defines a forefoot pad recess and wherein said system of interacting components further comprises a forefoot pad inserted into said forefoot recess.

3. The insole of claim 2, wherein said toe area of said base defines a valgus pad recess and wherein said system of interacting components further comprises a valgus pad inserted into said valgus pad recess.

4. The insole of claim 2, wherein said forefoot pod is formed of relatively resilient material whereby when a user engages in a toe-off phase of a step, energy transferred from the user's foot to said forefoot pad is returned and helps propel the foot at said toe-off.

5. The insole of claim 2, wherein said forefoot pod recess is shaped to accept a forefoot pod having a medial portion and said stability cradle has a top edge having a concave portion, and wherein said forefoot pod medial portion generally extends into said concave portion when said forefoot pod is situated in said forefoot pod recess.

6. The insole of claim 1, wherein said toe area of said base defines a valgus pad recess and wherein said system of interacting components further comprises a valgus pad inserted into said valgus pad recess.

7. The insole of claim 3, wherein said valgus pad is positioned on the lateral side of said insole.

8. The insole of claim 1, wherein said insole further comprises a top sheet having a foot contacting surface and an opposite surface, said opposite surface adhered to said base top side.

9. The insole of claim 8, further comprising a thin pad disposed between said base top side and said top sheet opposite side to form a transverse arch support.

10. The insole of claim 1, wherein said lateral heel pod is positioned in said insole so that is adjacent to the rear and lateral side of the heel bone of a user during use, thereby cushioning the impact of a user's heel strike motion.

11. The insole of claim 10, wherein said lateral heel pod is made of material having cushioning properties.

12. The insole of claim 11, wherein said material is polyurethane material having a durometer value of about Shore C 40-60 and a thickness of about 6 mm.

13. The insole of claim 12, wherein said durometer value is about Shore C 45-60.

14. The insole of claim 12, wherein said durometer value is about Shore C 50-55.

15. The insole of claim 1, wherein said stability cradle, said medial heel pod and said lateral heel pod provide control of the amount or rate of pronation of a user's foot.

16. The insole of claim 15, wherein said medial heel pod is made of a firmer material than said lateral heel pod, whereby the rate of pronation of a user's foot is reduced.

17. The insole of claim 16, wherein the durometer value of said medial heel pod is selected from 20 to 30 percent and 20 to 40 percent higher than the durometer value of said lateral heel pod.

18. The insole of claim 16, wherein said medial heel pod has a durometer value of about Shore C 65-70 and said lateral heel pod has a durometer value of about Shore C 50-55.

19. The insole of claim 16, wherein said medial heel pod has a durometer value of about Shore C 60 and said lateral heel pod has a durometer value of about Shore 45-50.

20. The insole of claim 15, wherein said medial heel pod is made of a softer material than said lateral heel pod, whereby the rate of pronation of a user's foot is increased.

21. The insole of claim 20, wherein the durometer value of said medial heel pod is selected from 20 to 30 percent and 20 to 40 percent lower than the durometer value of said lateral heel pod.

22. The insole of claim 1, wherein said lateral midfoot pad has similar firmness to said lateral heel pod.

23. The insole of claim 22, wherein said lateral midfoot pad is located so that it provides cushioning and control to a user's foot during a midstance portion of a step.

24. The insole of claim 4, wherein said forefoot pod is made of a layer of EVA material.

25. The insole of claim 4, wherein said forefoot pod has a Shore C durometer value of about 30-40.

26. The insole of claim 4, wherein said forefoot pod has angled grooves corresponding to hinge lines of joints of a user's foot, whereby said forefoot pad has increased flexibility during walking by a user.

27. The insole of claim 7, wherein said valgus pad is firmer than said base.

28. The insole of claim 27, wherein said valgus pad has a durometer value of about Shore 70.

29. The insole of claim 28, wherein said valgus pad is made of EVA.

30. The insole of claim 1, wherein said lateral heel pod, said medial heel pod and said lateral midfoot pods are non-removably affixed to said base bottom side defining said recess.

31. The insole of claim 1, wherein one or more of said lateral heel pod, said medial heel pod and said lateral midfoot pod are removably affixed to said base bottom side defining said recess.

32. The insole of claim 1, wherein said base is made of material having cushioning properties.

33. The insole of claim 32, wherein said base is made of one or more layers of foam.

34. The insole of claim 33, wherein said base has a top layer having a durometer value from about Shore C 25-55 and a bottom layer having about 4.5 mm of EVA foam having a durometer of about Shore C 40-65.

35. The insole of claim 33, wherein said base has a top layer having a durometer value of about Shore C 30-35 and an EVA bottom layer with a durometer value of about Shore C 45.

36. The insole of claim 33, wherein said base has a top layer having a durometer value of about Shore C 45-50 and a bottom layer having a durometer value of Shore C 60.

37. The insole of claim 1, wherein said base is molded in a shape which conforms essentially to the natural shape of the foot of a user with respect to said base top side.

38. The insole of claim 37, wherein said base top side has a raised edge that wraps around the heel area and extends partially along the sides of said insole, said sides comprising a medial side and a lateral side.

39. The insole of claim 38, wherein said insole is thicker on said medial side as compared with said lateral side.

40. The insole of claim 37, wherein said stability cradle of said insole is shaped to complement the shape of said base so as to fit securely adjacent to said base bottom side.

41. The insole of claim 40, wherein said stability cradle defines a medial arch area and a pod area, said stability cradle extending upward from horizontal so as to conform to said medial arch area which is adjacent a user's medial longitudinal arch during use.

42. The insole of claim 41, wherein said stability cradle defines one or more slots in said medial arch area which expose underlying base material to said bottom of said insole.

43. The insole of claim 42, wherein there are approximately ten slots in said stability cradle.

44. The insole of claim 42, wherein portions of said underlying base material project into said slots so that said base material is approximately flush with the outer surface of said stability cradle.

45. The insole of claim 44, wherein said base material bulges through said slots when said base material is compressed by a user's foot.

46. An insole having a top surface for contacting a user's foot and a bottom surface for contacting the inside of a user's shoe, comprising:

a. a base, said base having a base top side and a base bottom side, said base having a heel end, a toe end, a first lateral side defining an inner arch area and a second lateral side defining an outer border area, said lateral sides extending from said heel end to said toe end, said base bottom side defining a toe area, a forefoot area, and a stability area, said base molded of a material in a shape which essentially conforms to the shape of a user's foot, said base made of a foam material, said forefoot area defining a forefoot pad recess which has a medial extension;

b. a stability cradle made of semi-rigid material, said stability cradle having a cradle top side and a cradle bottom side, said stability cradle having a top edge having a medial notched area, said stability cradle defining at least three openings extending from said cradle top side to said cradle bottom side, said cradle top side having a shape complementary to said base bottom side and affixed adjacent said stability area of said base bottom side whereby said base bottom side and said openings define first, second and third recesses in said insole bottom surface, and wherein said medial notched area receives said medial extension of said forefoot pad recess; and c. a system of interacting cooperative components integrated into said base and said stability cradle, said system comprising a lateral heel pod inserted into said first recess, a medial heel pod inserted into said second recess, a lateral midfoot pad inserted into said third recess, and a forefoot pad inserted into said forefoot pad recess.

47. The insole of claim 46, wherein said toe area defines a valgus pad recess, and a valgus pad is inserted therein.

48. The insole of claim 46, wherein said stability cradle defines one or more slots through which said base bottom side may protrude.

49. The insole of claim 46, wherein said forefoot pod has angled grooves corresponding to hinge lines of joints of a user's foot, whereby said forefoot pad has increased flexibility during walking by a user.

50. The insole of claim 46, wherein said medial heel pod is made of a firmer material than said lateral heel pod, whereby the rate of pronation of a user's foot is reduced.

51. The insole of claim 46, wherein said medial heel pod is made of a softer material than said lateral heel pod, whereby the rate of pronation of a user's foot is increased.

* * * * *